US005590093A

United States Patent [19]

Scharstein et al.

[11] Patent Number: 5,590,093

[45] Date of Patent: Dec. 31, 1996

[54] DIGITAL SUNDIAL

[76] Inventors: Hans Scharstein, Euskirchenerstr. 37, 53894 Mechernich; Werner Krotz-Vogel, Weserstr. 13, 53332 Bornheim, both of Germany; Daniel Scharstein, 4 Pleasant View Ter., Middlebury, Vt. 05753

[21] Appl. No.: 487,343

[22] Filed: Jun. 7, 1995

[30] Foreign Application Priority Data

Sep. 7, 1994 [DE] Germany ..... 44 31 817.0
Sep. 7, 1994 [DE] Germany ..... 9414484 U

[51] Int. Cl.[6] ..... G04B 19/26; G04B 49/00; G04C 19/00

[52] U.S. Cl. ..... 368/15; 368/82; 368/223; 33/270; 33/271

[58] Field of Search ..... 368/10, 11, 15–17, 368/62, 79, 82, 223, 239; 33/269–271

[56] References Cited

U.S. PATENT DOCUMENTS

| | | | |
|---|---|---|---|
| 2,931,102 | 4/1960 | Thew | 33/62 |
| 4,255,864 | 3/1981 | Glendinning | 33/270 |
| 4,782,472 | 11/1988 | Hines | 368/15 |
| 4,890,269 | 12/1989 | Buckner et al. | 368/15 |
| 5,056,232 | 10/1991 | Cunningham | 33/269 |
| 5,197,199 | 3/1993 | Shrader | 33/270 |

OTHER PUBLICATIONS

Applied Optics: vol. 29, No. 32, pp. 4751–4752 (Nov. 10, 1990); *Holographic Sundial*; A. Góngora–T, Robin G. Stuart.

Scientific American: pp. 104–106; (Aug. 1991); *Mathematical Recreations; What in Heaven Is a Digital Sundial?*; Ian Stewart.

Digital Sundial—Solar Clock, Copyright 1981—Boon.

Kellogg, Robert L., "A True Digital Sundial," Journal of the North American Sundial Society, vol. 2, No. 3, pp. 4–10, Sep. 1995.

*Primary Examiner*—Vit W. Miska
*Attorney, Agent, or Firm*—Kenyon & Kenyon

[57] ABSTRACT

A digital sundial displays the current solar time in digits, words, or pictures. Two closely-spaced parallel masks project different images depending on the angular position of the sun in the following way: The first mask, a regular array of thin vertical slits, casts a striped light pattern onto the second mask. This light pattern is independent of the height of the sun. The second mask is composed of narrow stripes of the digits, words, or pictures to be displayed. The striped pattern of sunlight cast by the first mask illuminates exactly those stripes of the second mask corresponding to the image representing the current time. The light shining through both masks is projected onto a translucent viewing screen mounted closely behind the second mask, which results in a digital display of the time. A plate of light-refracting material can be inserted between the two masks, effectively linearizing the motion of the light pattern cast onto the second mask. Using this linearized version, it is possible to construct not only a sundial displaying the hours, but also a minute display which, for example, repeatedly displays the minutes of the current time in five-minute intervals.

20 Claims, 7 Drawing Sheets

DIGITAL SUNDIAL

FIELD OF THE INVENTION

The present invention relates to the art of indicating time using the position of the sun and more particularly to producing a digital display of the solar time.

BACKGROUND OF THE INVENTION

Sundials have been in use since ancient times and usually involve some means of casting a shadow onto an analog scale containing time markers. Similar to the hour hand of a regular clock, the position of the shadow on this scale indicates the current time. While many different variations of this basic principle have been proposed, few deal with the disadvantages of an analog displays which requires a certain skill of the observer and is limited in accuracy. Using a digital display overcomes these disadvantages, as evidenced by the success of digital clocks and watches. The object of the present invention is to transfer this advance to the domain of sundials.

A fictitious digital sundial was described in Ian Stewart's column "Mathematical Recreations" (Ian Stewart, "What in heaven is a digital sundial?", Scientific American, pages 104–106, 1991). In his article, Stewart builds on an idea first presented in Kenneth Falconer's book "Fractal Geometry" on page 89 (Kenneth Falconer, Fractal Geometry—Mathematical Foundations, John Wiley and Sons, 1990): In order to illustrate a theorem on the projection of fractals, Falconer describes a hypothetical digital sundial based on a three-dimensional fractal that casts different shadows in the shape of numbers.

This device, although mathematically plausible, can not be realized in practice for several reasons. Fractals have infinitesimally small structure, which would impede manufacturing of the device; furthermore, the theorem does not yield a method of constructing such a fractal. Most importantly, the theorem relies on a point-shaped light source and on geometrical optics (including straight-line projection), neither of which is true in the physical world, since (a) the disk of the sun subtends an angle of about one-half degree, and (b) diffraction of light imposes a lower limit on the size of any optical structure, so that a fractal with its infinitesimally small detail can not be used. Thus, even if it were be possible to manufacture such a fractal device, the laws of physics would prevent it from working.

A holographic sundial has been proposed which overcomes some of these problems by exploiting the wave nature of light (A. Gongora-T. and R. Stuart, "Holographic sundial", Applied Optics, 29:32, pages 4751–4752, 1990). The main disadvantage of this approach is the long and costly manufacturing process of the device, in which each displayed image has to be recorded separately, and the photographic material needs to be reoriented for each exposure. Furthermore, shrinkage of the photographic emulsion limits the angular precision.

Hungarian patent T62415 to Haszpra (1990) (international patent WO 94/03844) discloses a sundial with a transparent time scale whose shadow onto a viewing surface containing an index line indicates the time. Although the title of the patent claims a digital sundial, the device is just a variation of the traditional analog sundial, reversing the roles of shadow casting gnomon and time scale. Similar such variations include U.S. Pat. No. 2,931,102 to Thew (1960), and also U.S. Pat. No. 4,255,864 to Glendinning (1981) and U.S. Pat. No. 5,056,232 to Cunningham (1991), in which the sunlight itself marks the time on an analog scale in form of a bright projected line.

U.S. Pat. No. 4,782,472 to Hines (1988) discloses a solar clock with a digital display, in which a light gathering tube casts the sunlight onto an array of optical fibers that are coupled to a seven-segment display. This invention actually comprises a physically realizable digital sundial, but it has the drawback that the device is quite complex, and thus expensive to manufacture. Furthermore, since the light gathering tube and the display are two separate units only connected by a cable of optical fibers, it is not immediately obvious to the observer that the sun is responsible for creating the image of the time on the display (as opposed to, say, an electronic circuit). Having many components makes the device difficult to install and prone to damage. Finally, the principle underlying the invention only allows displays with a small number of discrete elements (such as seven-segment displays), and increasing the number of elements also increases the complexity of the device.

In light of the above, objects and advantages of the present invention are to provide a digital sundial which is physically realizable, which can be manufactured easily and inexpensively, which consists only of a few components and thus is robust, which is unlimited in the contents to be displayed, and whose function as a digital sundial is immediately apparent to an observer.

A more general object of the present invention is to provide an optical apparatus for digitally displaying the angular direction of a remote light source.

SUMMARY OF THE INVENTION

The present invention embodies a digital sundial, a device that displays the current time in digits, words, or pictures that change with the direction of the sunlight. Two closely-spaced parallel masks create the different images in the following way: The first mask, a so-called stripe mask, is an array of vertical slits that cast a striped pattern of light onto the second mask, a so-called digit mask, which is composed of narrow stripes of the digits, words, or pictures to be displayed. The sunlight shining through the first mask generates a light pattern that illuminates exactly those stripes of the second mask corresponding to the digits of the current time. This results in a digital display of the time. A diffusion screen, mounted closely behind the second mask, allows reading of the displayed time from oblique viewing directions.

A plate of light-refracting material can be inserted between the two masks, effectively linearizing the motion of the light pattern on the digit mask. Using this linearized version, it is possible to construct not only a sundial displaying the hours, but also a minute display showing, for example, the 12 five-minute intervals. As opposed to the hour display, where each digit is displayed only once during the day, in the minute display the same set of digits is repeatedly displayed every hour, as the same parts of the digit mask are illuminated by different slits of the stripe mask in an hourly cycle.

Variations on possible mask designs include displaying the time in seven-segment style, roman numerals, words or pictures. By using a pivotal mount allowing the sundial to be rotated about an axis parallel to the earth's axis of rotation, the displayed time can be adjusted easily to correct for the changing difference between solar and actual clock time, and to switch between standard and daylight savings time. By using two displays arranged at an angle the range of displayed hours can be extended. It is also possible to construct a small table-top version of the sundial in which the display is read or illumintated through a horizontal mirror or a wall-mounted sundial in which the display is read or illuminated through a vertical mirror.

DETAILED DESCRIPTION OF A PREFERRED EMBODIMENT

Figure 1:
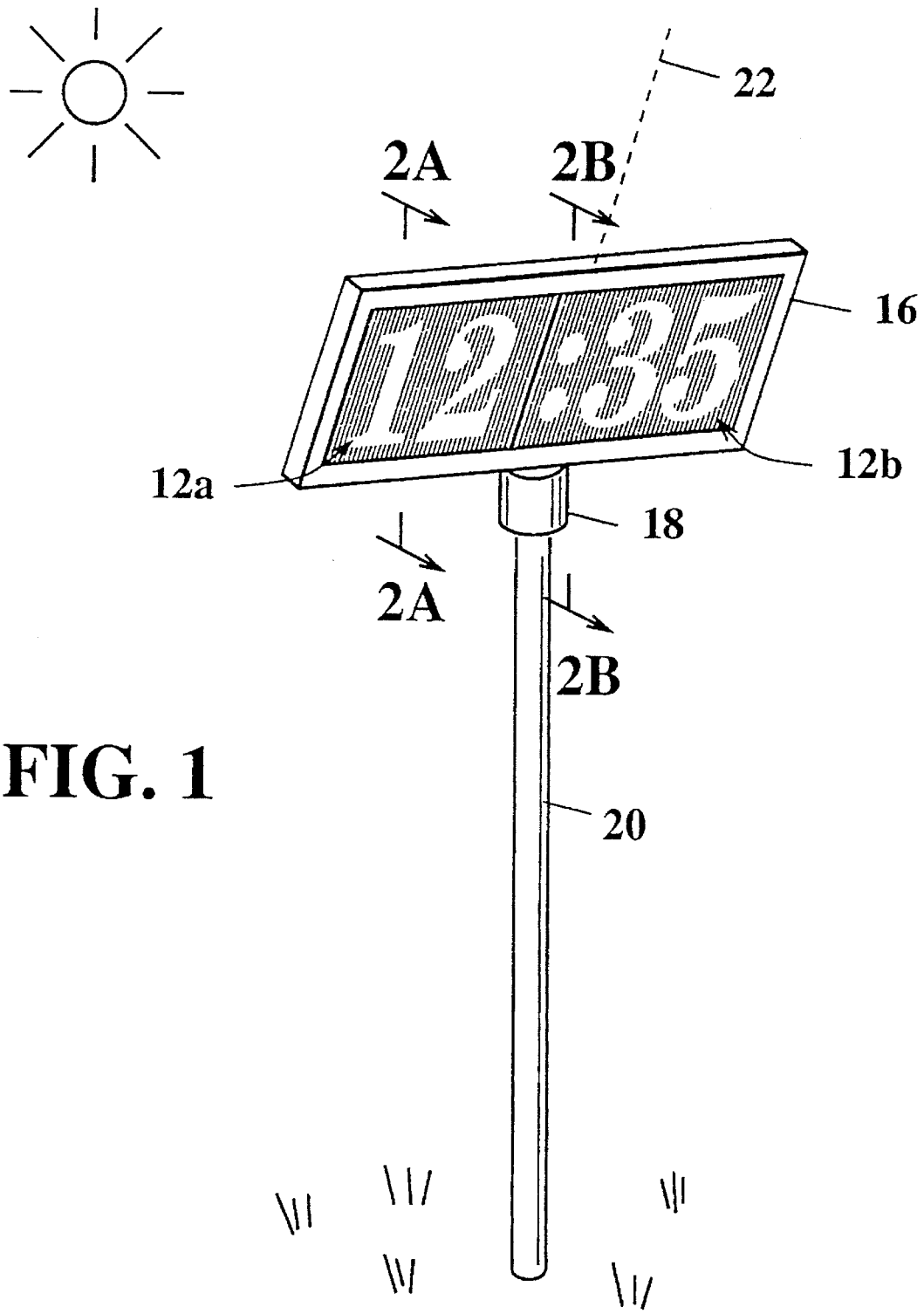
FIG. 1 is a perspective view of a digital sundial in accordance with a preferred embodiment of the invention.
Figure 2A:
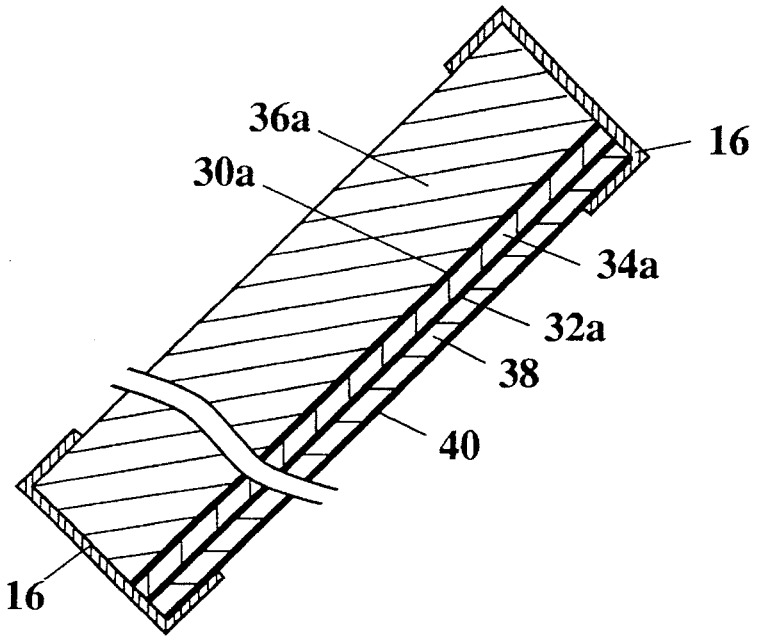
FIGS. 2A and 2B are sectional views through the hour and minute display of the sundial shown in FIG. 1 taken substantially along lines A—A and B—B.
Figure 2B:
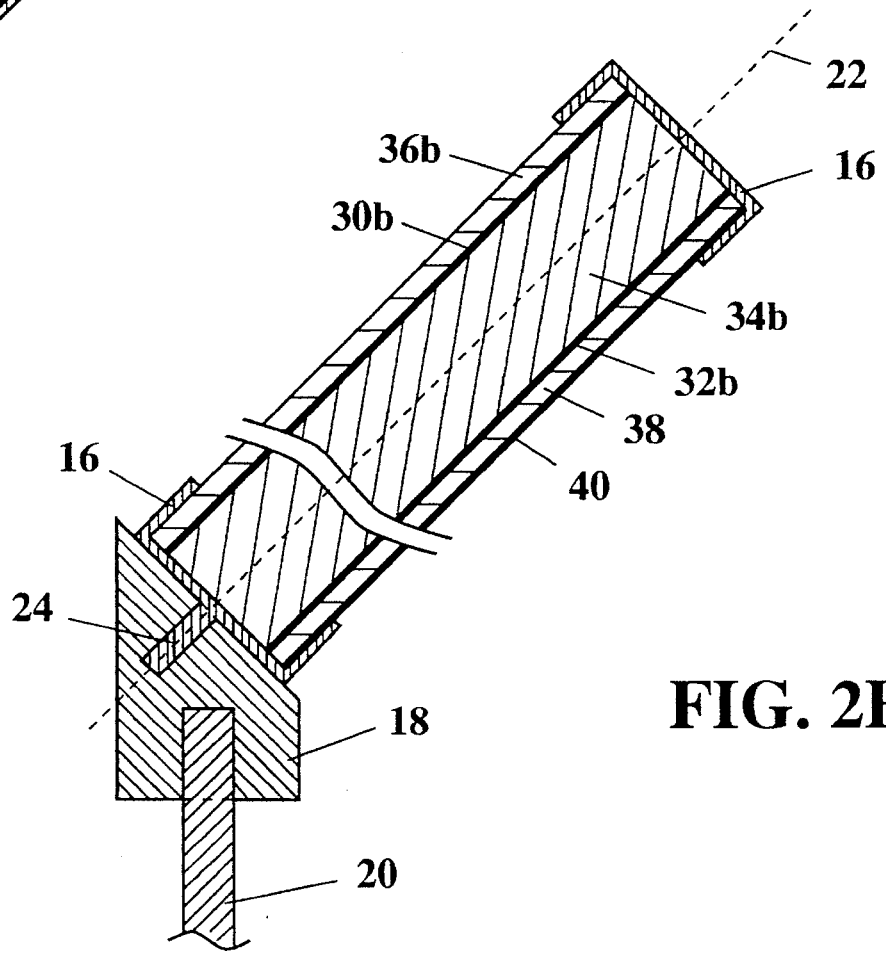

FIGS. 1, 2A, and 2B show a digital sundial embodying the present invention. The sundial comprises an hour display 12*a* and a minute display 12*b*, contained by a frame 16, which is supported by a base 18 and a stand 20. Base 18 serves to position the sundial such that its axis 22 is parallel to the earth's axis of rotation, that is, at an angle to the horizontal which is equal to the latitude of the geographical site of the sundial. By means of a pivot 24 (shown in FIG. 2B), Frame 16 containing displays 12*a* and 12*b* can be rotated about axis 22 to adjust the displayed time. As will be explained below, for each angular position of the sun with respect to axis 22, the sundial displays images of digits representing the current solar time in digital form. The particular digital sundial illustrated by FIGS. 1–3 displays the current time in five-minute intervals ranging from 8:00 am to 5:55 pm.

FIGS. 2A and 2B show vertical cross-sectional views of hour display 12*a* and minute display 12*b* respectively, taken substantially along lines A—A and B—B in FIG. 1. Both displays contain a planar stripe mask 30 and a planar digit mask 32, each of which is a thin opaque sheet with a specific pattern of light-transmitting apertures. Masks 30 and 32 are preferably separated by a central transparent plate 34 made from glass, plexiglas, or any other transparent material, but can also be separated by air. For reasons explained below, the thickness of transparent plate 34*a* in the hour display is preferably about one-tenth of the thickness of the corresponding plate 34*b* in the minute display. Masks 30 and 32 are preferably realized by applying an opaque coating to both sides of transparent plate 34 (the apertures are formed by leaving areas uncoated). Alternatively, masks 30 and 32 can comprise a photographically produced film or transparency having opaque and transparent regions, or a thin rectangular sheet made from any opaque material having light-transmitting apertures, positioned adjacent to transparent plate 34.

To increase weather resistance (and also to ensure planarity of the masks), each display preferably further includes two protecting transparent plates 36 and 38, positioned adjacent to masks 30 and 32. The sun-facing protecting plates 36*a* and 36*b* (of hour and minute display respectively) preferably have different thickness to achieve equal overall thickness of both displays. Finally, each display preferably also includes a matte light-diffusing viewing surface 40, onto which the different images are projected, thus enabling observation of these images from different directions. Viewing surface 40 is preferably integral with the sun-opposing transparent plate 38, being formed, for example, by etching or sand-blasting the outer surface of plate 38. Alternatively, viewing surface 40 can be embodied by a light-diffusing coating or lamination applied to plate 38.

Figure 3A:
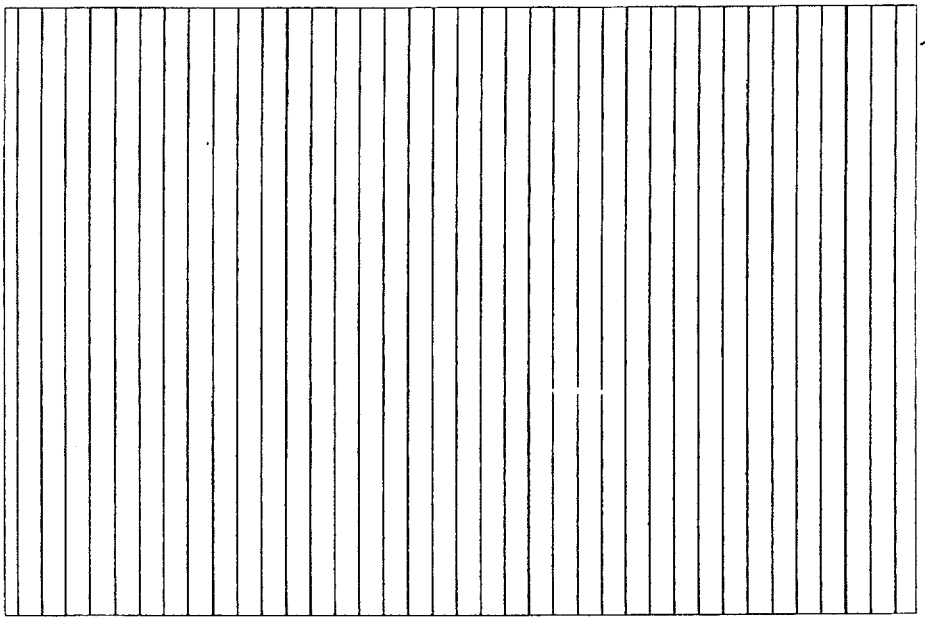
FIGS. 3A and 3B show the negative stripe and digit masks of an hour display and a minute display.
Figure 3A:
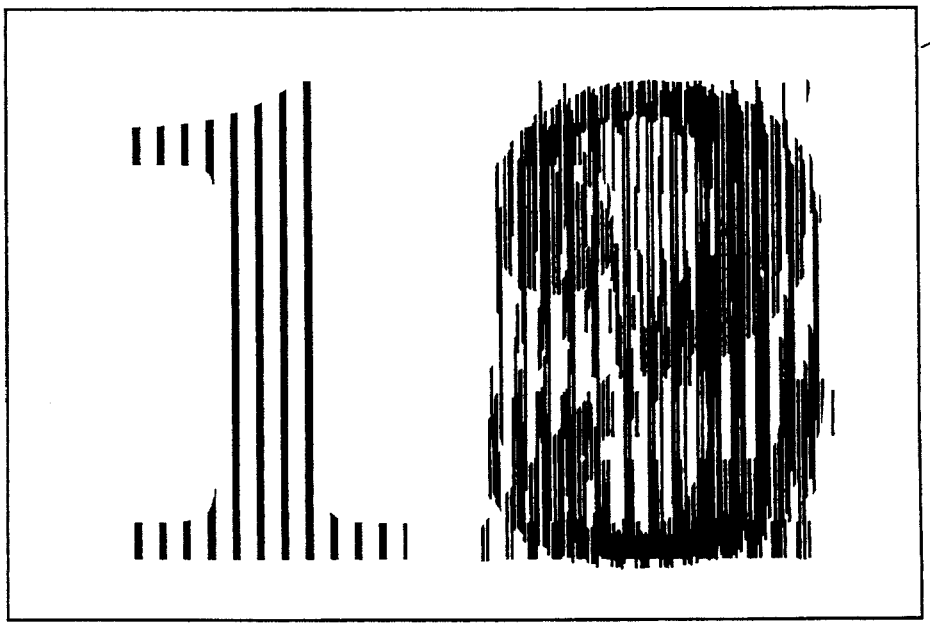
Figure 3B:
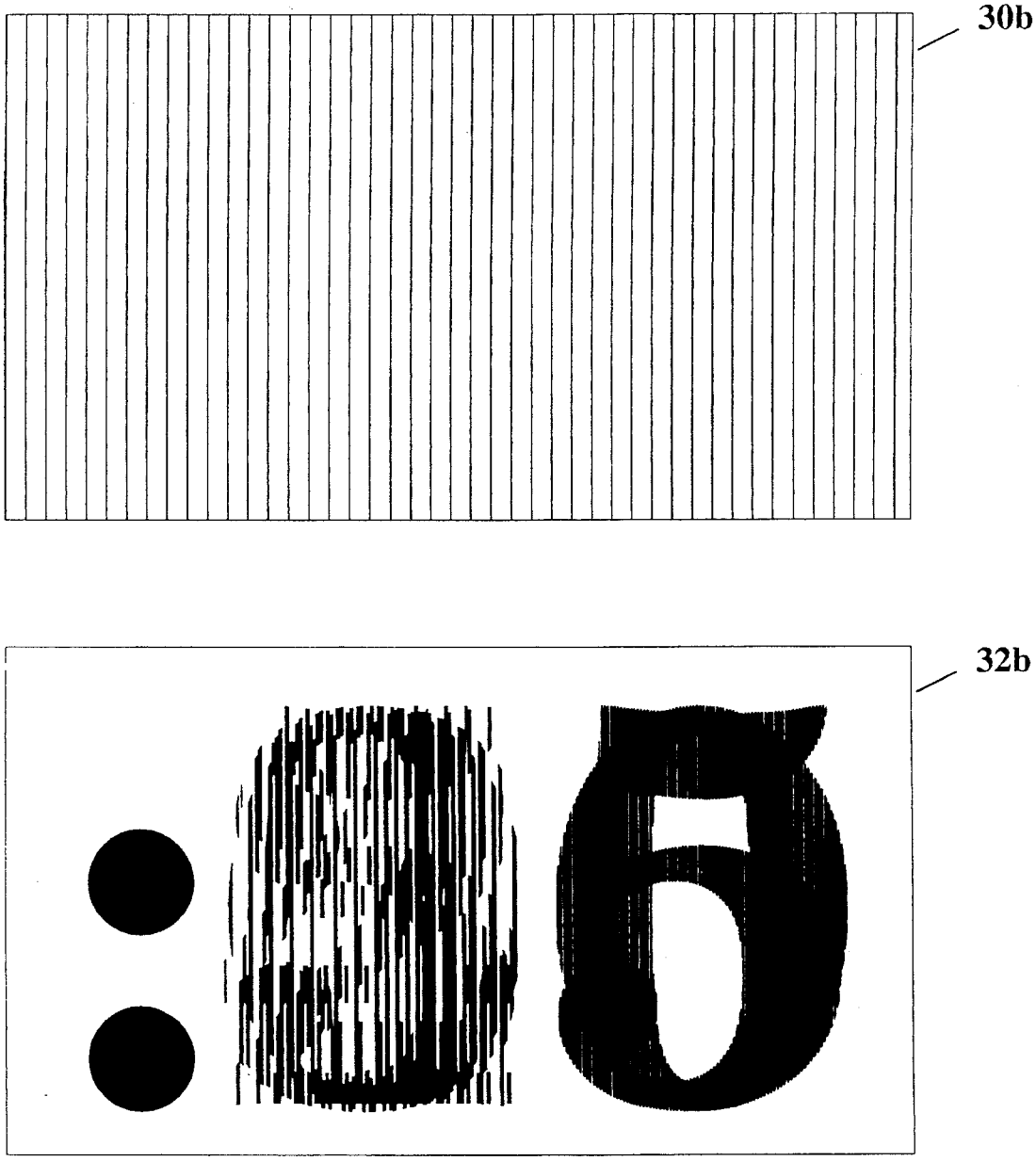

FIGS. 3A and 3B show stripe masks 30*a* and 30*b*, and digit masks 32*a* and 32*b* of hour display 12*a* and minute display 12*b* respectively. The opaque regions are shown in white, and the apertures are shown in black. As can be observed, stripe masks 30*a* and 30*b* are regular arrays of thin parallel vertical slits, while the apertures in digit masks 32*a* and 32*b* are sampled from different digits.

We will now explain the operation of the sundial. Since the two displays operate in a very similar way, the discussion will focus mainly on the hour display. The minute display will be briefly discussed below.

When hour display 12*a* is illuminated by a remote light source, stripe mask 30*a* casts a striped pattern of light onto digit mask 32*a*. The apertures in digit mask 32*a* have the form of narrow stripes sampled from all the digits that are to be displayed during the day. The arrangement of these stripes is such that at a given time exactly those stripes that correspond to the digit representing this time are illuminated by the light shining through stripe mask 30*a*. For example, at 9 am, the striped sunlight coming from stripe mask 30*a* falls exactly onto those apertures that correspond to the numeral 9. Consequently, the light that passes through both masks forms a pattern of closely-spaced vertical stripes in shape of the numeral 9. This pattern is projected onto viewing surface 40, yielding an image of the number 9 in thin, closely-spaced bright stripes, which can be observed from any viewpoint on the sun-opposing side of display 12*a*.

Figure 4A:
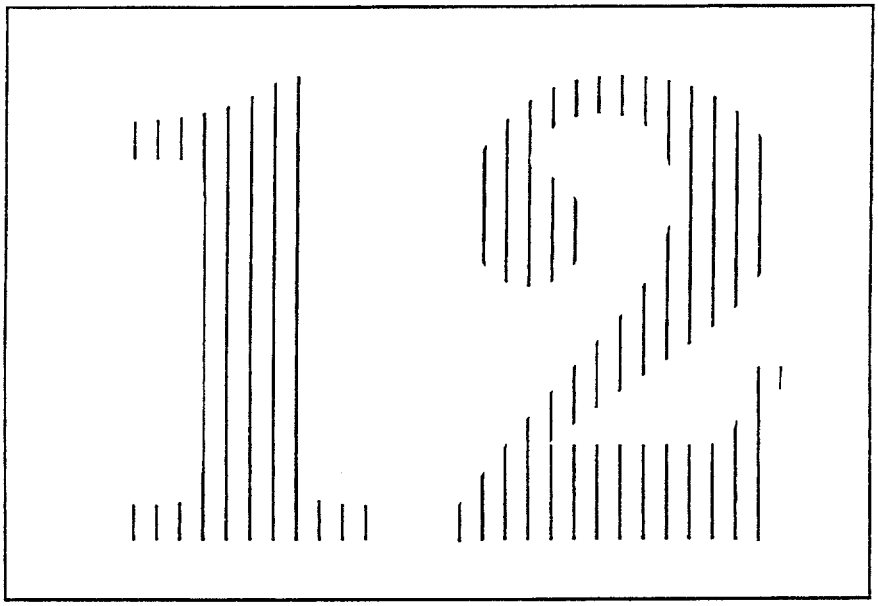
FIGS. 4A and 4B show the reverse of the images generated by the masks in FIGS. 3A and 3B at 12:35 pm.

One hour later, at 10 am, the sun has performed an apparent motion of 15 degrees due to the rotation of the earth. The thin stripes cast by stripe mask 30*a* have moved slightly to the left on digit mask 32*a*, now falling onto apertures that correspond to the digits 1 and 0, yielding an image of the number 10. This process repeats for all the images to be displayed in the course of one day. For an example of the appearance of the displayed images, FIG. 4A shows the reverse (i.e., black on white instead of white on black) of the image generated by stripe and digit masks 30*a* and 32*a* in FIG. 3 at 12:35 pm.

The apertures in digit mask 32*a* in FIG. 3A represent the images of the numbers 8, 9, 10, 11, 12, 1, 2, 3, 4, and 5. During the course of a day, the sunlight falling through a single slit in the stripe mask generates a part of each of those images. Thus, each period of the digit mask contains a thin vertical stripe sampled from each of those numbers. One can observe this periodic pattern in the digit mask in FIG. 3A. Note that the periods of stripe and digit masks are the same.

The change of the sun's declination during the course of the year does not affect the displayed time, since, similar to the gnomon of a regular sundial, the slits in the stripe mask 30*a* are parallel to axis 22 which in turn is parallel to the axis of the earth. Thus, the displayed image only depends on the horizontal angular position of the sun and is independent of the seasonably varying height of the sun.

It will be appreciated that the images encoded in digit masks 32*a* and 32*b* in FIGS. 3A and 3B only serve as an example and can easily be varied. Alternate embodiments of the invention (not shown) can use different digit masks composed from arbitrary pictures which are sampled in thin vertical stripes. Simple variations include using a different typesetting font (e.g., Courier or Helvetica), or using digits in "seven-segment" style, or roman numerals. In fact, any picture whose detail is limited to the resolution of the stripe mask can be displayed, including letters, characters, words, symbols, or pictograms. Furthermore, the time intervals during which different images are displayed can be arbitrarily chosen by varying the width of their corresponding stripes in digit mask 32. The relationship between the geometry of the masks and the time intervals during which the different images are displayed will be discussed in detail below.

Figure 5:
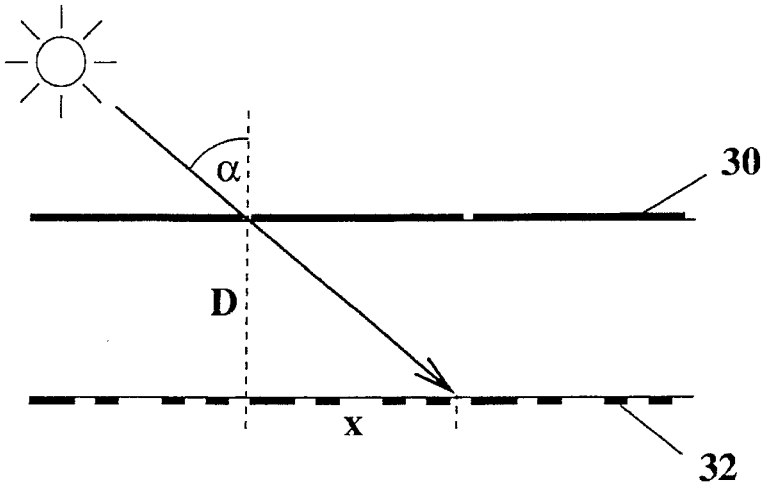
FIG. 5 illustrates the position of a sun ray on the digit mask using a schematic sectional view.

For ease of exposition we will first discuss an alternate embodiment of an hour display comprising stripe mask 30*a* and digit mask 32*a*, but not including transparent plates 34, 36, and 38. The sun's azimuthal angle (i.e., horizontal position) changes by 15 degrees per hour due to the rotation of the earth. As is also the case with conventional planar sundials, we have to consider that a shadow cast onto a plane does not move linearly, but with the tangent of this angle. For illustration, FIG. 5 shows a schematic cross-sectional view of hour display 12*a* taken perpendicularly to axis 22 in FIG. 1. In FIG. 5, D denotes the distance between the two parallel masks 30*a* and 32*a*. If T is the time in hours (ranging from 0 to 24), the position x of a ray of light falling through a slit in stripe mask 30*a* onto digit mask 32*a* is $x=D\cdot\tan(\alpha)$, where $\alpha=(T-12)/15$ degrees is the angle of this light ray to the orthogonal (assuming that the display is adjusted to be orthogonal to the plane defined by axis 22 and the sun's position at noon). The motion based on the tangent of angle $\alpha$ is not linear, especially for large angles. It is possible to correct for the nonlinearity by using stripes of different widths within each period in the digit mask, i.e., narrower stripes around 12 noon, and wider stripes for the morning and the afternoon.

Figure 6:
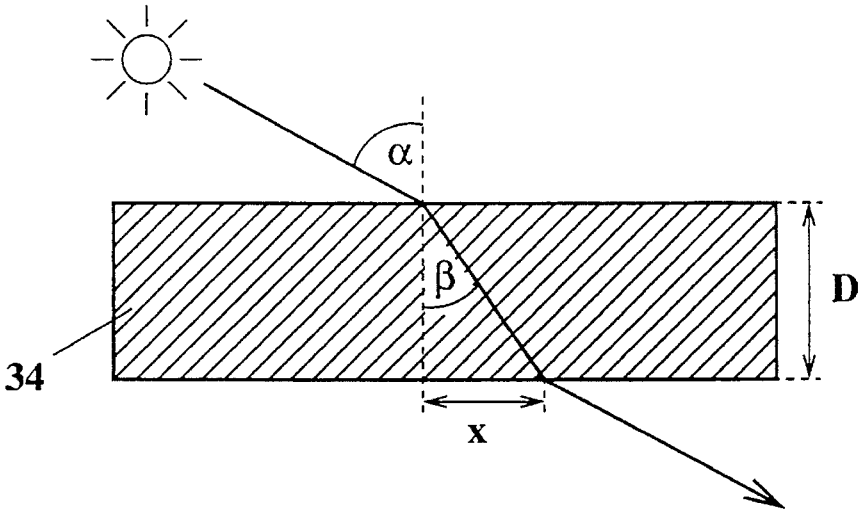
FIG. 6 illustrates the refraction of light passing through a transparent plate.

However, a different and more elegant way to achieve almost perfect linearity over a wide range of hours is used in the preferred embodiment of the present invention which includes a central transparent plate 34. As illustrated in FIG. 6, the light experiences refraction as it passes obliquely through this plate. As before, let D denote the distance between the two masks (and thus also the thickness of plate 34), and $\alpha$ denote the angle of the incoming light. In addition, let $\beta$ denote the angle of the refracted light, and let n denote the index of refraction of plate 34.

According to the law of refraction, $$\sin(\alpha)=n\cdot\sin(\beta)$$

or $$\beta=\arcsin(\sin(\alpha/n)).$$

Thus, the position of a light ray on the digit mask is now $$\begin{aligned} x &= D\cdot\tan(\beta) \\ &= D\cdot\tan(\arcsin(\sin(\alpha/n))) \\ &= D\cdot\sin(\alpha)/\sqrt{n^2-\sin^2(\alpha)} \end{aligned}$$

Figure 8A:
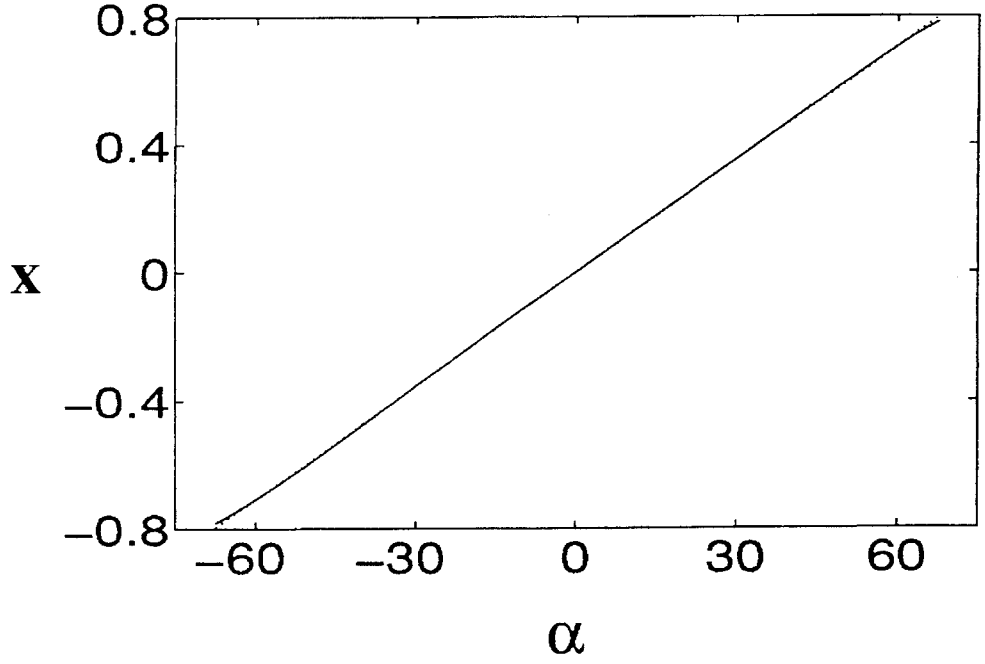
FIGS. 8A and 8B illustrate the absolute and relative nonlinearity of the display.
Figure 8B:
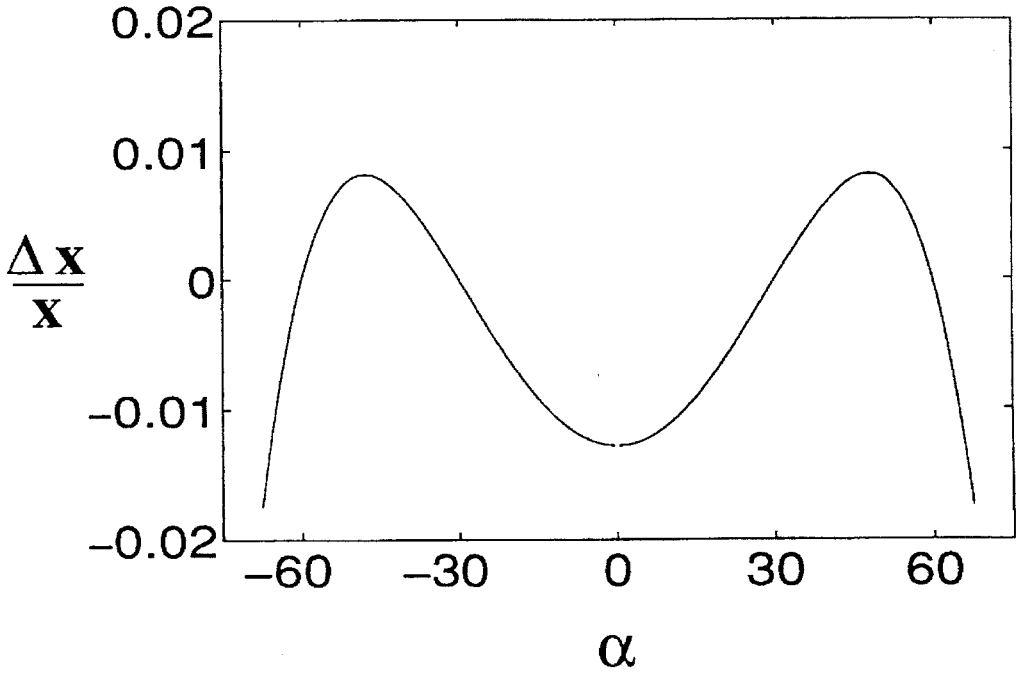

Most solid transparent materials (such as glass, plexiglas, clear plastic, etc.) have refraction indices n between 1.4 and 1.6. For these refraction indices, x as a function of $\alpha$ is almost perfectly linear over a wide angular range. FIGS. 8A and 8B illustrate this linearity for a sheet of plexiglas with n=1.5, which is the preferred embodiment of central transparent plate 34. FIG. 8A shows x as a function of $\alpha$ (using a solid line) and a linear function (using a dotted line). FIG. 8B shows the relative error $\Delta x/x$ with respect to the linear function. As can be seen, the relative remaining nonlinearity is less than 2% for angles $\alpha$ in the range of ±67.5 degrees, corresponding to times between 7:30 am and 4:30 pm.

Since for angles even more oblique the brightness of the display decreases substantially due to both reflection losses and the shrinking diameter of the light beams passing through the masks, a correction for the remaining nonlinearity is generally not necessary. This enables the construction of repeating minute display 12*b* which will be discussed below.

Note that adding protecting plates 36 and 38 does not change angle $\beta$, and thus does not affect the above analysis.

Figure 7:
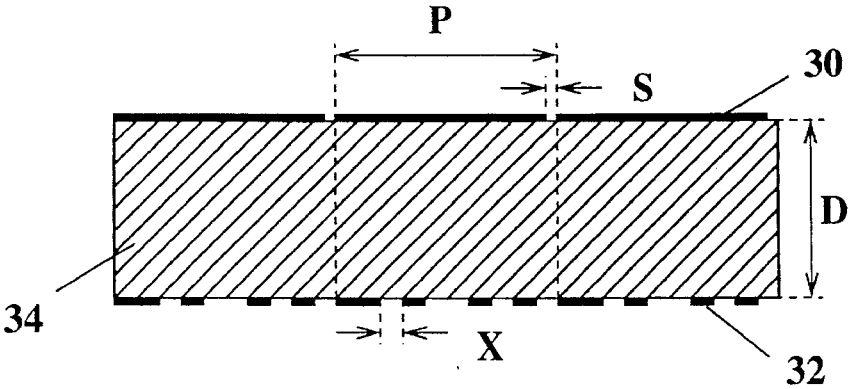
FIG. 7 illustrates the geometry of a display using a schematic sectional view.

We will now develop the relationships between the different measurements involved in the construction of the sundial. To illustrate the geometry of hour display 12*a*, FIG. 7 shows a schematic cross-sectional view taken perpendicularly to axis 22 in FIG. 1. As before, D denotes the thickness of transparent plate 34, and n denotes its index of refraction. We enforce the condition of linearity at an angle of incident light $\alpha_0=60$ degrees (4 hours after the light falls on the mask perpendicularly).

This yields an average hourly motion $$\begin{aligned} X &= 1/4\cdot D\cdot\tan(\arcsin(\sin(60°)/n)) \\ &= 1/4\cdot D\cdot(\sqrt{3}/2)/\sqrt{n^2-3/4} \end{aligned}$$

Given n=1.5, we get $$\begin{aligned} X &= 1/4\cdot D\cdot\sqrt{2}/2 \\ &= 0.177\cdot D. \end{aligned}$$

This particular choice of $\alpha_0$ yields a reasonably well balanced relative error $\Delta x/x$, as can be observed in FIG. 8B. One could also choose an $\alpha_0$ that optimizes the average or maximal relative error over a certain interval of angles. The choice of this interval, however, would still be arbitrary.

The range of hours to be displayed determines the period P of both digit and stripe mask. For a range of N hours, the period must be N·X. The masks in FIG. 3A display ten different hours (from 8:00 am to 5:55 pm), thus N=10, yielding a period P=1.77·D. Within each period, stripe mask 30*a* has one narrow transparent slit and is otherwise opaque, while digit mask 32*a* has the N adjacent stripes corresponding to the N digits to be displayed. Each such stripe has width X, and will be illuminated for exactly one hour.

The speed of transition from one hour to the next is determined by the width S of the slits in the stripe mask. It is desirable that these changes happen quickly, but decreasing S also decreases the absolute brightness of the display. A limit on the possible resolution is imposed by the angle subtended by the disc of the sun, which is about one-half degree. The image of each slit is widened by this angle, which corresponds to a transition time of 2 minutes. Realistic values for the slit width S correspond to transition times between 5 and 20 minutes. Given a transition time, the slit width S has to be the corresponding fraction of X, the width of the hour stripe. For example, for a transition time of 20 minutes we get $S=20/60\cdot X=\frac{1}{3}\cdot X$.

In principle it would be possible to build a sundial that displays more than one image per hour, say, for example, one that displays an image every 10 minutes. In practice, however, this would lead to unrealistically many (and narrow) divisions of a single period of the masks, resulting in coarse sampling of each image and reduced overall brightness. Fortunately, we can construct a minute display avoiding these drawbacks by exploiting the linearity of the arrangement: Since the minute display repeats with every hour, we only have to ensure that the striped pattern of light cast by the stripe mask is offset by exactly one period after a single hour. The apparent size of the sun still imposes a limit of 2 minutes on the achievable resolution. A realistic step size is 5 minutes, yielding the 12 numbers 00, 05, . . . , 55.

In the following discussion of the measurements of minute display **12*b* we will use the symbols P', D', and X' to distinguish them from the measurements of hour display 12*a*. In the minute display, the full period P' needs to be illuminated during a single hour. Thus the period P' of minute masks 30*b* and 32*b*** is $$P' = 1/4 \cdot D' \cdot \sqrt{2}\ /2$$

and the width of a minute stripe in mask **32*b* is X'=P'/N'. Due to the higher resolution of the minute dial, it is advisable to increase the distance D' between the two masks (i.e., by using a thicker transparent plate 34*b***). Preferable is a ratio of about 1:10 between the thicknesses D and D', leading to similar periods P and P' and therefore to similar looking images of the numbers for both displays. Also, the necessary precision in manufacturing and adjusting the two sets of masks is approximately the same given this ratio.

Figure 4B:
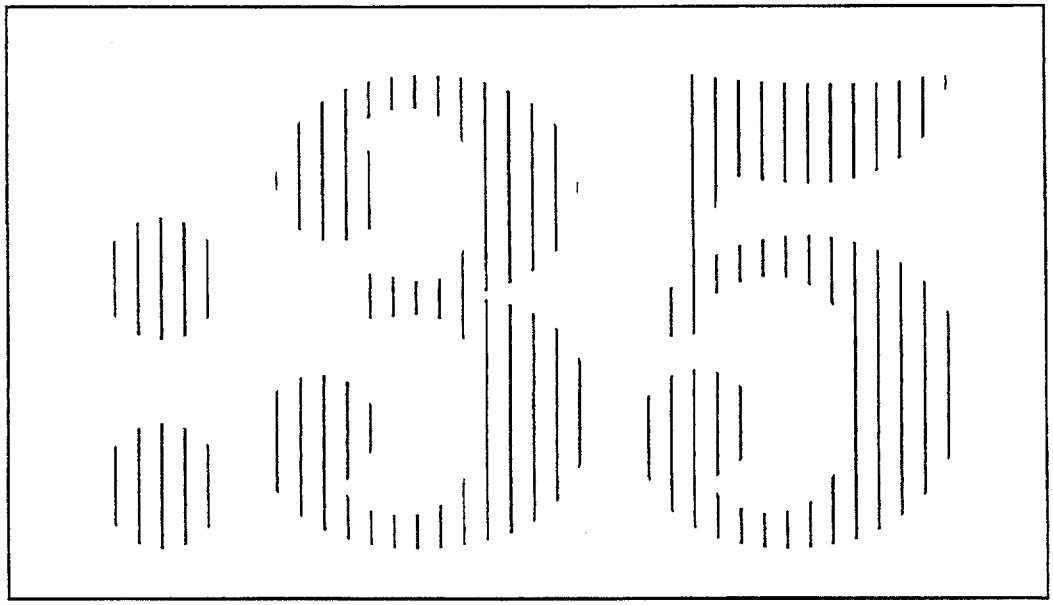

FIG. 3B shows stripe and digit masks **30*b* and 32*b* of minute display 12*b*** which were designed according to the specifications above. FIG. 4B shows the reverse (i.e., black on white instead of white on black) of the image generated by these masks at 35 minutes after the hour.

The specific sundial described above is only one of many possible embodiments. The following extensions and modifications are not shown in the figures, but should be obvious to those skilled in the art.

To see the display of the sundial with highest contrast, one needs to stand behind and underneath the sundial on its sun-opposing side. This requires the sundial to be installed at a relatively high position. Alternatively, the sundial can be installed at a low position together with a horizontal or slightly slanted mirror, through which the display can be read at a comfortable angle of gaze. In this case, of course, the display has to show the images mirror-imaged. Using an embodiment with a mirror is especially suited for a table-top version of the digital sundial. Including a mirror is also preferable at locations of small latitude (i.e., close to the equator), which require a substantially horizontal positioning of the sundial. A mirror is further of use if the sundial is to be installed on a south-facing wall. In this case the mirror can be mounted flush with the wall, allowing a person to observe the display from behind while standing in front of it.

It is also possible to install a mirror between the sun and the display, so that the display is indirectly illuminated by the sun through the mirror. In this case, the correct positioning of the display depends on the orientation of the mirror. In particular, the display must be positioned such that the slits in the stripe mask are now parallel to the reflected axis of the earth. A mirror positioned substantially vertically reverses the direction of the sun's apparent motion, in which case the display must generate the images in reverse sequence. In all cases the mirror must be large enough to guarantee illumination of the display for all possible positions of the sun.

As is the case with all sundials, the correct positioning of the digital sundial depends on the user's geographical location. An adjustable base (common in the art) can be included to allow users at any geographical site to orient the axis of the digital sundial to be parallel to the earth's axis of rotation. In the northern hemisphere the axis has to point towards the celestial north pole, while in the southern hemisphere it has to point towards the celestial south pole. A different display is necessary in the southern hemisphere since the images need to be generated in reverse sequence. As described above, the sundial can easily be set and adjusted by means of a pivotal mount allowing the sundial to be rotated around its axis. Adding two stops defining an angle of 15 degrees to the mount facilitates easy changing between standard and daylight savings time.

The preferred embodiment of the sundial described above can display a range of about 9 hours. To achieve a wider range, which might be desirable during summer, an arrangement of two displays at an angle can be used. Using an angle of 90 degrees between the two displays results in an extension of the displayed time range by 6 hours.

It will be appreciated that the basic principle underlying the present invention is to use a static arrangement of two masks that project different images in different directions, in which the first mask has small apertures defining a certain sampling pattern, and the second mask has apertures representing a set of different images sampled by this pattern. The sampling pattern of the preferred embodiment of the digital sundial is a regular array of stripes, but it is also possible to use an array of dots, allowing resolution of both angular directions (although at the cost of reduced overall brightness). Thus, in a broader sense, the present invention is a passive optical instrument for digitally displaying the angular direction of any remote light source.

Note that the term "digital" as used herein is intended to refer to a discrete set of images to be displayed (that is, digital as opposed to analog). The term "digital" does not restrict the contents of these images to be digits.

The term "mask" as used herein is intended to refer to any structure which has a predetermined pattern of light transmitting apertures. Similarly, the term "aperture" is intended to refer to any structure which will pass light, as by voids, transparency, refraction or the like. In particular, the pattern-generating mask can comprise an array of small lenses instead of simple holes to increase the brightness of the display. In this case, this mask needs to be positioned closer to the light source than the digit mask, while for masks with simple holes the order does not matter (i.e., in the latter case either mask could be positioned closer to the light source).

All of the extensions and modifications outlined above are intended to be within the scope of the claims below. Still other embodiments will become readily apparent to those skilled in the art upon reading this specification and the claims to follow.

BIBLIOGRAPHY

1. Ian Stewart, "What in heaven is a digital sundial?", Scientific American, pages 104–106, 1991.
2. Kenneth Falconer, Fractal Geometry—Mathematical Foundations, John Wiley and Sons, page 89, 1990.
3. A. Gongora-T. and R. Stuart, "Holographic sundial", Applied Optics, 29(32), pages 4751–4752, 1990.
4. Int. Pat. No. WO 94/03844 to Haszpra, "Digital Sundial with bright wandering time scales", 1990.
5. U.S. Pat. No. 2,931,102 to Thew, "Sun Dial", 1960.
6. U.S. Pat. No. 4,255,864 to Glendinning, "Sun Clock", 1981.

7. U.S. Pat. No. 5,056,232 to Cunningham, "Remote light source responsive visual time indicator", 1991.
8. U.S. Pat. No. 4,782,472 to Hines, "Solar Clock with a digital display", 1988.

We claim:

1. A digital sundial comprising a digital display, said display comprising (a) a light-casting mask that casts a predetermined light pattern when illuminated by a remote light source, and (b) a light-selecting mask having opaque and transparent regions and being statically positioned at a predetermined orientation to and at a predetermined distance from said light-casting mask, wherein said opaque regions block part of said light pattern, thereby creating at least two different images depending on the angular position of said light source with respect to said display.

2. The digital sundial of claim 1 further including a diffusing translucent viewing surface onto which said images are projected.

3. The digital sundial of claim 1, wherein said images created by said light-selecting mask represent the current solar time.

4. The digital sundial of claim 3 wherein said images are selected from the group consisting of digits in a typesetting font, digits in seven-segment style, digits ranging from 1 to 12, digits ranging from 1 to 12, accompanied by "am" and "pm", digits ranging from 0 to 23, roman numerals, words, and pictures.

5. The digital sundial of claim 3 further including a mount allowing said display to be rotated about an axis parallel to the earth's axis of rotation to facilitate setting and adjusting of the displayed time.

6. The digital sundial of claim 3 further comprising an additional display positioned at an angle so as to extend the range of hours displayed.

7. The digital sundial of claim 1 further including a light-reflecting surface through which said images can be observed.

8. The digital sundial of claim 1 further including a light-reflecting surface positioned such that said light source illuminates said display through said light-reflecting surface.

9. The digital sundial of claim 1 wherein said light-casting mask comprises a thin planar opaque sheet having an array of regularly spaced apertures.

10. The digital sundial of claim 9 wherein said light-casting mask is positioned closer than said light-selecting mask to said light source.

11. The digital sundial of claim 8 wherein said light-selecting mask is positioned closer than said light-casting mask to said light source.

12. The digital sundial of claim 9 wherein said apertures form elongated parallel slits extending across said mask, and wherein said mask is positioned such that the earth's axis of rotation is parallel to said elongated slits.

13. The digital sundial of claim 9 further including a transparent light-refracting plate positioned between said light-casting mask and said light-selecting mask, thereby effectively linearizing the motion of said light pattern on said light-selecting mask for a light source moving around said display with constant angular velocity.

14. The digital sundial of claim 13 wherein said images repeat hourly and represent the minutes of the current solar time.

15. The digital sundial of claim 1 wherein said light-casting mask comprises a regular array of lenses, and wherein said array is positioned closer to said light source than said light-selecting mask.

16. A digital sundial comprising a digital display, said display comprising (a) a planar transparent plate of light refracting material of predetermined thickness, said plate having first and second surfaces, and (b) two opaque masks, each of said masks having a plurality of light-transmitting apertures of predetermined size and shape at predetermined positions, said masks being positioned adjacent to said first and second surfaces of said sheet respectively, wherein, when illuminated by a remote light source, said display projects at least two different images which depend on the angular position of said light source with respect to said display.

17. The digital sundial of claim 16 further including a diffusing translucent viewing surface onto which said image is projected.

18. The digital sundial of claim 16 wherein said apertures of said first mask form a regular array of elongated parallel slits, and wherein said display is positioned such that the earth's axis of rotation is parallel to said elongated slits, and wherein said apertures of said second mask are positioned in such a way as to project an image representing the current solar time when illuminated by the sun.

19. The digital sundial of claim 18 comprising two of said displays, first of said displays displaying the hours, and second of said displays displaying the minutes of the current solar time.

20. An optical direction indication apparatus for digitally displaying the angular position of a remote light source, said apparatus comprising (a) a light-casting mask that casts a predetermined light pattern when illuminated by said remote light source, and (b) a light-selecting mask having opaque and transparent regions and being statically positioned at a predetermined orientation to and at a predetermined distance from said light-casting mask, wherein said opaque regions block part of said light pattern, thereby creating at least two different images depending on the angular position of said light source, said images representing in digital form the relative angular position of said light source with respect to said apparatus.

* * * * *